United States Patent [19]

Payne

[11] 3,958,049

[45] May 18, 1976

[54] METHOD OF INSPECTING AND TREATING SUCKER ROD

[75] Inventor: Bobby L. Payne, Midland, Tex.

[73] Assignee: Rodco, Inc., Odessa, Tex.

[22] Filed: July 19, 1974

[21] Appl. No.: 490,210

Related U.S. Application Data

[63] Continuation-in-part of Ser. No. 195,658, Nov. 4, 1971.

[52] U.S. Cl. ..... 427/327; 166/176; 166/244 C

[51] Int. Cl.[2] ..... B05D 1/18; B05D 3/12

[58] Field of Search ..... 117/49, 94, 128; 148/6.15 R, 6.15 Z; 252/8.3, 8.5 R, 8.5 B, 8.55 E, 8.55 B; 166/176, 173, 310, 311, 244 C; 106/14

[56] References Cited

UNITED STATES PATENTS

| | | | |
|---|---|---|---|
| 2,875,110 | 2/1959 | Rossander | 148/6.15 Z |
| 2,927,068 | 3/1960 | Marsh et al. | 117/94 |
| 3,397,092 | 8/1968 | Cavanagh | 148/6.15 Z |
| 3,615,891 | 10/1971 | Davis | 148/6.15 R |

*Primary Examiner*—Caleb Weston
*Attorney, Agent, or Firm*—Marcus L. Bates

[57] ABSTRACT

A continuous process for reclaiming sucker rod which has been used downhole in a borehole. The salvaged rod is degreased, visually inspected, subjected to a shot peening operation, analyzed for structural imperfections, imparted with a protective coating which includes an inhibiting agent, and stored for subsequent use.

16 Claims, 5 Drawing Figures

METHOD OF INSPECTING AND TREATING SUCKER ROD

REFERENCE TO RELATED PATENT APPLICATIONS

My copending U.S. Pat. application Ser. No. 195,658 filed Nov. 4, 1971, of which this patent application is a Continuation in Part. The prior art: Cavanagh U.S. Pat. No. 3,397,092; Rossander U.S. Pat. No. 2,875,110; Marsh et al. U.S. Pat. No. 2,927,068; Davis U.S. Pat. No. 3,615,891; Roland U.S. Pat. No. 2,528,787.

BACKGROUND OF THE INVENTION

Many oil wells employ a downhole reciprocating type production pump in order to lift fluid from the lower extremity of a borehole to the surface of the ground. Joints of rod are made up into a string which extends from the surface of the ground downhole to a production pump so as to enable a pump jack located on the surface of the ground to reciprocate the rod which in turn actuates the downhole production pump. From time to time, for one reason or another, the rod must be removed from the borehole. It is customary upon removal of the rod from the borehole to subject the individual joints of rod to various analyses and tests, and to recondition the rod so as to enable the structurally sound rod to be returned to service.

Replacement of sucker rod in a well bore is an expensive endeavor for the reason that the rod is often made up into a continuous string which exceeds ten thousand feet in length, and therefore special equipment and trained personnel are required when the replacement becomes necessary.

Some joints of sucker rod enjoy a life of many years while other joints experience a limited life of only a few days duration. Many people skilled in the art of sucker rod theorize that rod which is properly reclaimed is more reliable than new joints of rod.

It is old in the art to degrease sucker rod, to clean and surface harden rod by shot peening, or to subject the rod to electro-magnetic inspection, called "magnaflux". After the rod has been cleaned, surface hardened and inspected, it is usually painted and stored for subsequent use. It has been found that many joints of sucker rod treated in this manner enjoy several additional years life when again placed into service in a borehole. Yet, for some reason heretofore unknown, one or more joints of new or reclaimed rod will sometimes fail, although it appears to be structurally sound. When an entire string of sucker rod has been removed from a well bore and subjected to analyses, it often is discovered that the structural integrity of a few joints has degenerated because small cracks or fractures have developed, or that the corrosive environment of the well has deteriorated the rod so as to render it useless.

Hydrogen ion embrittlement is a phenomenon which occurs when case-hardened metallic goods are placed in an acid environment. It is believed that the hydrogen ion found in acid solutions is sufficiently small in size to physically enter small crevasses or fissures at or near the surface of the metallic goods, thereby progressively opening the crack or fissure, and further encouraging the hydrogen ion intrusion. The phenomenon continues in this manner, much like a wedge being driven into an existing void or crack.

In manufacturing sucker rod, the metal composition will sometime appreciably change along the length of the rod for reasons best understood and appreciated by the metallurgist. It is desirable to ascertain the magnitude of this metallic composition change and to eliminate those rods wherein the change in composition could possibly adversely affect the structural integrity of the rod.

SUMMARY OF THE INVENTION

This invention comprehends a process for treating used sucker rod, comprising: degreasing the rod after which it is visually inspected; shot peening the exterior surface to clean and to surface harden the rod; electronically inspecting the rod to determine the structural integrity thereof; magnafluxing the pin ends of the rod; demagnetizing the rod; coating the exterior surface of the rod with an inhibitor, whereupon the rod is then preserved, graded, and stored for subsequent use.

Resistance to corrosion fatigue is unexpectantly enhanced by the elimination of microscopic surface defects brought about as a result of the shot peening operation. Subsequent chemical treatment of the rod surface with an inhibitor isolates the metal from corrosion attack. Hence, a structurally sound rod which has been processed in accordance with the present invention will exhibit an unexpected prolonged life in a borehole.

A primary purpose of this invention is to provide a method by which the life expectancy of tubular goods can be extended.

Another object of the present invention is to provide a method of reclaiming sucker rod so as to provide rod having an unusually long life expectancy.

A further object of this invention is to disclose and provide a method of rejuvenating and treating sucker rod so as to enable the rod to survive downhole in an oil well.

A still further object of this invention is to provide a method of treating tubular goods which reduces the probability of failure of the tubular goods when they are used downhole in an oil well.

DETAILED DESCRIPTION OF THE PREFERRED EMBODIMENT

Figure 1:
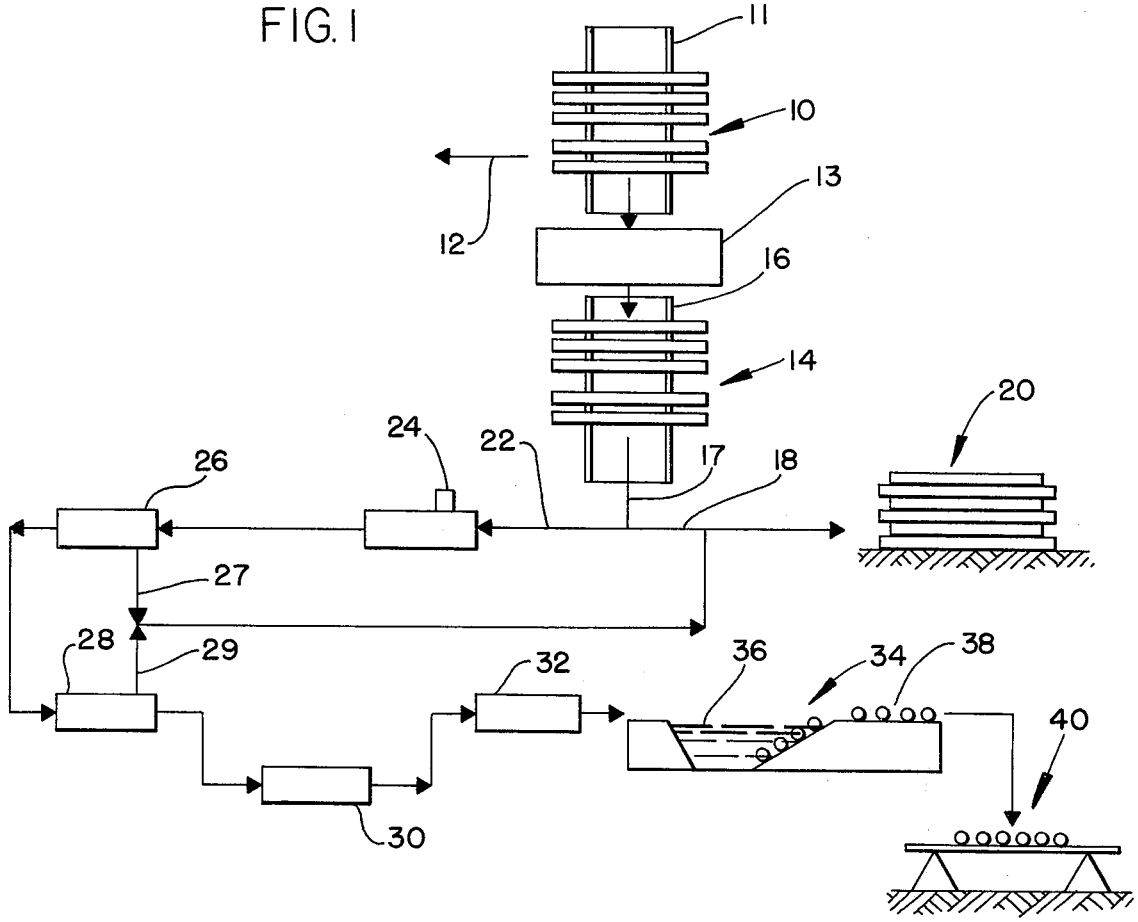
FIG. 1 diagrammatically sets forth a flow sheet illustrating the essence of the present invention.

In FIG. 1 there is disclosed used sucker rod 10 supported from a pipe rack 11. The rod has been used downhole in a borehole. In carrying out the present invention, couplings which may be attached to the sucker rod are removed from the end thereof as illustrated by the numeral 12. The rods are degreased by submerging them in a hot oil bath 13, after which the degreased rods 14 are placed upon a pipe rack 16 so that they can drain and be subjected to careful visual inspection.

The visually defective rod is removed at 18 and discarded at 20 while the apparently good rod at 22 is subjected to a mechanical cold working process which further cleans the exterior surface of the degreased rod.

The mechanical cold working step of the process preferably is carried out by shot peening at 24 after which the rod is electronically inspected at 26 by means of the differential eddy current method, the details of which will be more fully discussed later on in this disclosure. Numeral 27 indicates defective rods which are removed from the continuous process. The inspected acceptable rod from 26 is next subjected to a magnetic induction inspection 28 by means of the flux leakage method, the details of which will be more fully disclosed later on in this disclosure. Numeral 29 indicates that defective rods are removed from the continuous process.

The pin ends of the remaining rods are magnafluxed at 30 by the Magna-glo (TM) process. The couplings from 12 are also magnafluxed using the powdered metal process, and any defective couplings removed from the process. The remaining sound rods are demagnetized at 32 and treated with an amine organic inhibiting agent at 34 by dipping the rod within a corrosion inhibitor bath 36 after which the rods are drained at 38, identified and graded according to API specifications, and subsequently stored at 40.

Figure 2:
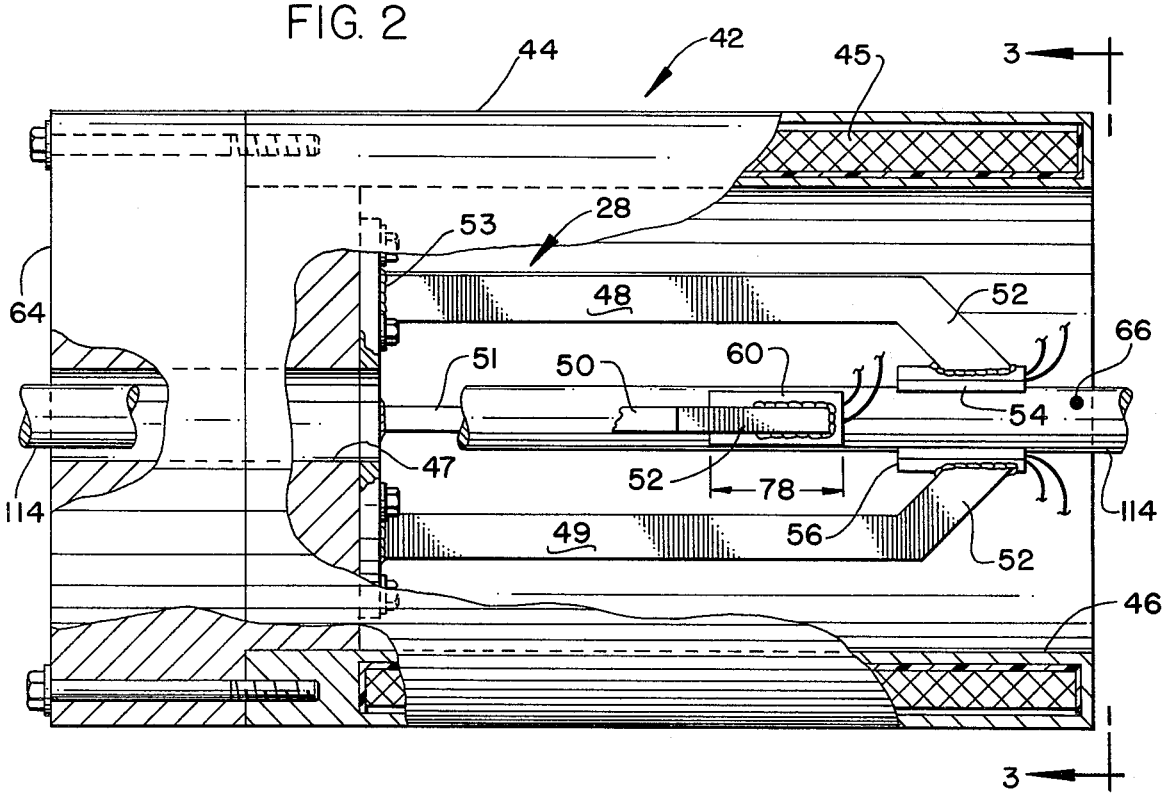
FIG. 2 is a broken, part cross-sectional, side elevational view of one form of apparatus which is used for carrying out part of the invention.
Figure 3:
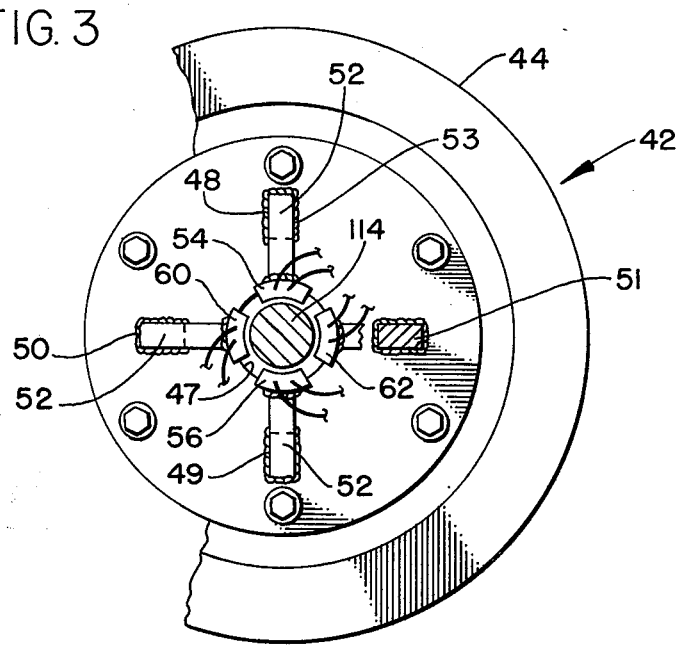
FIG. 3 is a broken, cross-sectional view taken along line 3—3 of FIG. 2; and, FIGS. 4 and 5 are part diagrammatical, part schematical illustrations which set forth the use of apparatus disclosed in the foregoing figures.
Figure 4:
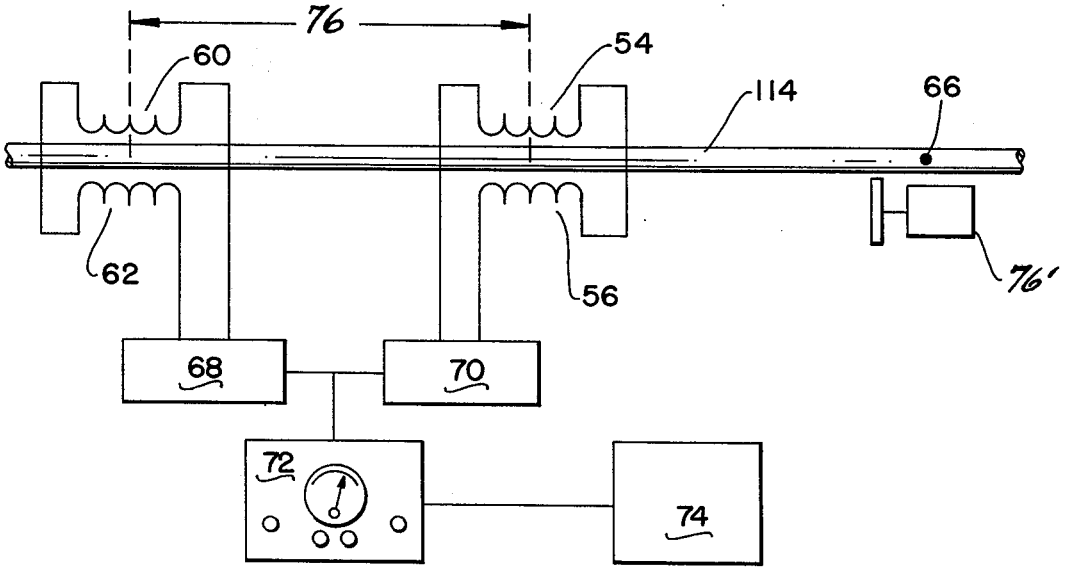

In FIG. 2, in conjunction with FIGS. 3 and 4, there is disclosed apparatus 42 for carrying out the electronic inspection indicated by numeral 28 in FIG. 1. The apparatus comprises a cylindrical body 44 having a magnetic induction coil 45 which defines an enlarged axial passageway 46 concentrically arranged respective to passageway 47 which receives a longitudinally disposed sucker rod 114 therethrough. The apparatus has radially spaced resilient arms 48 – 51 outwardly depending therefrom in parallel relationship relative to the axial center line of the cylinder 44. The arms are inwardly bent at 52 and support coils 54 – 56 on the free marginal-depending end thereof.

As seen in FIG. 3, in conjunction with FIG. 2, the before mentioned housing has an inner exterior face which receives the anchored end of the arms at 53. Coils 60, 62 are opposed to one another and longitudinally spaced from the similarly before mentioned opposed coils 54, 56. The housing can be provided with a suitable mount means at 64 to enable the apparatus to be properly mounted relative to the continuously longitudinally traveling rod. It will be noted that numeral 66 indicates a flaw in the rod.

As seen in FIG. 4, the before mentioned opposed coils are electrically connected to circuitry 68 and 70 which in turn is connected to an analyzer means 72 having visual indicator means thereon for determining the presence of any flaws which might occur within the metal. A tape recorder 74 records the signal produced at 72 so that the resulting signal produced by the flaws in the rods may be subsequently analyzed should such an expedient be deemed desirable.

Figure 5:
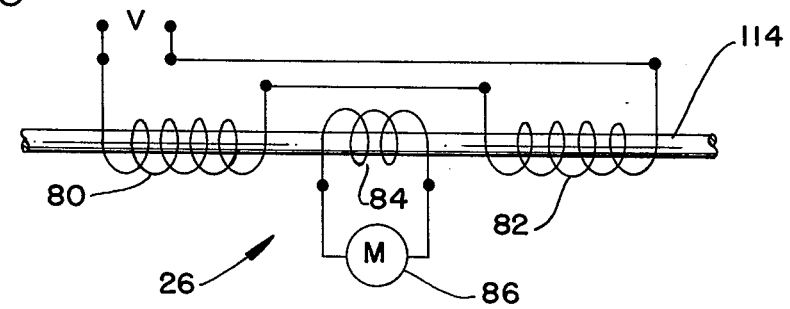

In FIG. 5, the eddy current apparatus 26 is schematically illustrated respective to a rod 114. Coils 80, 82, and 84 are spaced from one another and each arranged concentrically respective to the rod. Coils 80 and 82 are provided with a source of current at V while meter 86 is connected to coil 84.

In operation, rods which have been used downhole in a borehole are accumulated at 10 until a sufficient number are on hand to warrant processing in a continuous manner. The couplings are removed from the rod at 12 and individually processed. The rod is degreased by dipping the rod into a hot oil bath 13 so that the individual joints of sucker rod can be visually inspected at 14. The visually acceptable rod enters a conveyor system at 22 where the rod is rotated at 53 r.p.m. while traveling longitudinally at a speed of 30 feet per minute.

A rod speed in excess of this value is unacceptable because visual inspection becomes unreliable; and, shot peening becomes less effective. A rod speed less than this value curtails production in direct proportion thereto.

The rod passes through a Wheelabrator (TM) shot peening apparatus which subjects the exterior surface thereof to a shower or bombardment of metallic shot causing a plastic flow of the surface fibers of the metal. This action places the surfaces fibers of the metal in residual compression while the inner fibers are in tension so that working stresses that ordinarily impose a tension stress on the surface is offset by the residual stress brought about by the cold working action of the shot. The net result is a considerably greater endurance limit of the peened material. Shot peening increases resistance to fatigue fractures and accordingly increases the fatigue life of the metal. Shot peening further reduces corrosion and fatigue of the rod because the surface has greater continuity and accordingly there are no cracks or pits available for intrusion of hydrogen ions.

The eddie-current inspection apparatus 26 is used to detect stress or fatigue failures, hardness variations, and difference in metallic construction or composition along the rod. The signal is provided by the series connected coils 80, 82 which are connected to a source of current V. Centrally located coil 84 is connected to a sensor 86 which detects the recited differences by measuring any changes in the field strength of coil 84.

The rods are next subjected to magnetic induction inspection at 28, also called "flux leakage". This is an electronic magnetic induction inspection which determines the presence of fatigue cracks, corrosion, surface laminations, slugs, inclusions, and similar physical defects in the rod. A strong magnetic field is placed about the rod by means of coil 45, after which the surface of the rod is scanned with the four detector heads 54, 56, 60, and 62 which measure the induced magnetism. The resultant signal from the detectors is fed through an electronic analyzer system 68, 70, and to a strip chart recorder at 72. The cleaning of the rod removes debris and foreign matter down to the bare surface. This improvement in the rod surface anables the electronic inspection apparatus to render a positive means for ascertaining defects in the rod structure.

The signal recorded at 74 will indicate the passage of the pin ends through the detectors because of the radical change in rod mass. This change in signal strength is used to index the recorder with the individual rod thereby facilitating subsequent study of the recorded characteristics of this step of the process.

As the rod 114 moves longitudinally along the axial center line of bore 47, it is simultaneously subjected to a rotating action by apparatus schematically indicated by numeral 76'. The four measuring coils or detector heads 54, 56, 60, and 62 are arranged in opposed and spaced relation relative to one another and to the rod, with each head lying in intimate slidable contact with the rod. The distances 76 and 78 as well as the rotational velocity of the rod respective to its longitudinal travel through the bore 46 is adjusted so that any area 66 located on the surface of the rod must pass under one of the detector heads 54, 56 or one of the heads 60, 62.

The pin ends of the rod are magnafluxed at 30 by the Magna-glo (TM) inspection process, wherein the threaded upset pin end of the magnetized sucker rod is coated with fluorescent magnetic particle fluid and thereafter viewed under ultra-violet light. This enables visual detection of any fatigue cracks or other physical anomalies which are evidenced by the accumulation of metallic particles in proximity of the defect.

At this time the pin and shoulder area of the rod is also visually inspected under a magnifying glass to detect damaged threads or abused shoulder faces, and the rod diameter checked for wear rate. It is contemplated that this last measurement could be carried out electronically if such an expedient was deemed desirable.

The demagnetization of the rod preferably is attained by the provision of a coil at 32 which employs a strong alternating current for causing the entire rod to be rendered magnetically non-attractive. This important step of the operation provides a rod which will not be attracted to the production tubing nor will the rod per se attract particles of metal which may be flowing uphole from the production apparatus.

The organic inhibitor agent 36 is an amine base organic material which forms a surface film that is sufficiently resilient to avoid cracking, sagging, or dripping in various climatic extremes. The inhibitor agent enables protection from ambient conditions to be enjoyed for up to two years in dry areas and is effective downhole in the borehole for 10 to 14 days.

After the rods have been inspected and treated, they are identified and graded by color coding according to API specifications so that an improper selection of rod for a rod string will not be made. In order to show the different grades of rod, a band of white, blue, yellow, or green, respectively; is used to denote low tensile, nichol alloy, low tensile, high tensile, or high tensile nichol alloy; respectively. This expedient prevents a low tensile rod from being inadvertently selected for use where a high tensile rod should instead have been selected, for example.

I claim:

1. A continuous process for improving ferrous metal sucker rods wherein the rods are protected against corrosion and hydrogen ion embrittlement comprising the steps of:

1. using the metal sucker rods downhole in a borehole;
2. removing the metal sucker rods of step (1) from the borehole;
3. cleaning the surface of the rods of step (2). to remove debris and scale therefrom;
4. mechanically cold working and further cleaning the exterior surface of the cleaned rods of step (3) by shot peening the surface thereof;
5. carrying out (4) by moving the rod longitudinally while rotating the rod about its longitudinal central axis at a rate which exposes the entire outer surface area of the rod to the action of the shot peening of step (4);
6. electronically inspecting the rods by the eddycurrent inspection method to determine the symmetry of composition;
7. electronically inspecting the rods by the flux leakage method to determine the presence of flaws therein;

8. carrying out steps (6) and (7) by moving the rod longitudinally at 30 feet per minute while rotating the rod about its longitudinal central axis at a rate of 53 revolutions per minute which exposes the entire outer surface area of the rod for inspection;
9. inspecting the pin ends of the rod to determine the presence of flaws therein;
10. discarding those rods of steps (69 and (7) and (9) whose structural integrity is deficient for carrying its designed load;
11. demagnetizing the remaining rods of step (10) to reduce the magnetic attractive properties thereof;
12. coating the exterior surface of the rods of step (11) with an organic inhibiting agent;
13. carrying out the coating step immediately following the inspection and demagnetizing steps; and, carrying out the inspection steps immediately following the mechanical cold working step so as to avoid subsequent oxidation and contamination of the cleaned rod surface.

2. The process of claim 1 wherein step 12 is carried out by dipping the rods into an oil soluble paint having the organic inhibitor mixed therewithin.

3. The process of claim 1 wherein the organic inhibiting agent is an amine organic material.

4. The process of claim 1 wherein the organic inhibiting agent is an amine organic material;

step (7) is carried out by engaging opposed exterior surfaces of the rod with opposed inductance coils at spaced locations along the longitudinal length of the rod;

measuring the change in the inductance of the coils to determine the symmetry of composition of the rod; and, spacing the distance between the opposed coils an amount respective to the rate of rotation of the rod so that the entire rod surface is subjected to the electronic inspection.

5. The process of claim 1 wherein step (7) is carried out by engaging opposed exterior surfaces of the rod with opposed inductance coils at spaced locations along the longitudinal length of the rod; and, measuring the inductance of the coils to determine the symmetry of composition of the rod.

6. The process of claim 5 and further including the step of spacing the distance between the opposed coils an amount respective to the rate of rotation of the rod so that the entire rod surface is subjected to the electronic inspection.

7. The process of claim 1 wherein step (6) is carried out by measuring the difference in the magnetic properties along the rod; and, step (7) is carried out by measuring the flux leakage at four different spaced apart areas along the surface of the rod.

8. The process of claim 7 wherein the rod is color coded to identify its tensile strength and composition.

9. The process of claim 7 wherein the pin ends of the rod are magnafluxed and further including the step of inspecting the rod for wear rate.

10. A continuous process for improving ferrous metal sucker rods wherein the rods are protected against corrosion and hydrogen ion embrittlement, comprising the steps of:

1. using the metal sucker rods downhole in a borehole;
2. removing the metal sucker rods of step (1) from the borehole;

3. cleaning the surface of the rods of step (2) to remove debris and scale therefrom;
4. mechanically cold working and further cleaning the ) surface of the cleaned rods of step (3) by shot peening the surface thereof while moving the rod longitudinally and at the same time rotating the rod about its central axis to assure that the entire surface area thereof is subjected to the shot peening operation;
5. electronically inspecting the rods to determine the symmetry of composition;
6. electronically inspecting the rods to determine the presence of flaws therein;
7. rotating the rod about its longitudinal central axis at 53 revolutions per minute while moving the rod longitudinally at a rate of 30 feet per minute which subjects the entire outer peripheral surface to the inspection of steps (5) and (6);
8. demagnetizing the rods to reduce the magnetic attractive properties thereof;
9. discarding those rods of step (5) and (6) whose structural integrity is deficient for carrying its designed load;
10. coating the exterior surface of the remaining sound rods of step (9) with an organic inhibiting agent;
11. carrying out the coating step immediately following the inspection steps; and, carrying out the inspection steps immediately following the mechanical cold working step so as to avoid subsequent oxidation and contamination of the cleaned rod surface.

11. The process of claim 10 wherein step (10) is carried out by dipping the rods into an oil soluble paint having the organic inhibitor mixed therein.

12. The process of claim 10 wherein the organic inhibiting agent is an amine organic material.

13. The process of claim 10 wherein the organic inhibiting agent is an amine organic material;

wherein step (6) is carried out by engaging opposed exterior surfaces of the rod with opposed inductance coils at spaced locations along the longitudinal length of the rod;

measuring the inductance of the coils to determine the symmetry of composition of the rod; and, spacing the distance between the opposed coils an amount respective to the rate of rotation of the rod so that the entire rod surface is subjected to the electronic inspection.

14. The method of claim 10 wherein step (5) is carried out by measuring the difference in the magnetic properties along the rod; and, step (6) is carried out by measuring the flux leakage at four different spaced apart areas along the surface of the rod.

15. The process of claim 10 wherein step (6) is carried out by contacting opposed exterior surfaces of the rod with opposed inductance coils at spaced locations along the longitudinal length thereof; and, measuring the inductance of the coils to determine the symmetry of composition of the rod.

16. The process of claim 15 and further including the step of spacing the distance between the opposed coils an amount respective to the rate of rotation of the rod so that the entire rod surface is subjected to the electronic inspection.

* * * * *

UNITED STATES PATENT OFFICE

CERTIFICATE OF CORRECTION

PATENT NO. : 3,958,049

DATED : May 18, 1976

INVENTOR(S) : Bobby L. Payne

It is certified that error appears in the above-identified patent and that said Letters Patent are hereby corrected as shown below:

Claim 1, Column 6, Line 8, substitute --(6)-- for "(69".

Claim 10, Column 7, Line 4, substitute --exterior-- for ")".

Signed and Sealed this

Fifth Day of October 1976

[SEAL]

*Attest:*

RUTH C. MASON
*Attesting Officer*

C. MARSHALL DANN
*Commissioner of Patents and Trademarks*